United States Patent [19]

Mochida et al.

[11] Patent Number: 4,463,349

[45] Date of Patent: Jul. 31, 1984

[54] ELECTRONIC LOCK SYSTEM WITH AUDIBLE ENTRY MONITOR

[75] Inventors: Haruo Mochida, Yokohama; Keiichi Shimizu, Tokyo; Hirotoshi Namazue, Yokohama, all of Japan

[73] Assignee: Nissan Motor Company, Ltd., Tokyo, Japan

[21] Appl. No.: 428,234

[22] Filed: Sep. 29, 1982

[30] Foreign Application Priority Data

Oct. 2, 1981 [JP] Japan ..... 56-156097

[51] Int. Cl.[3] ..... H04Q 4/00; E05B 49/00

[52] U.S. Cl. ..... 340/825.32; 340/365 E; 340/825.56

[58] Field of Search ..... 340/825.31, 825.32, 340/365 E, 543, 825.56

[56] References Cited

U.S. PATENT DOCUMENTS

| | | | |
|---|---|---|---|
| 3,587,051 | 6/1971 | Hovey . | |
| 3,593,816 | 7/1971 | Kazaoka . | |
| 3,633,167 | 1/1972 | Hedin . | |
| 3,691,396 | 9/1972 | Hinrichs . | |
| 3,710,316 | 1/1973 | Kromer . | |
| 3,751,718 | 8/1973 | Honchett, Jr. . | |
| 3,754,213 | 8/1973 | Morroni et al. . | |
| 3,764,859 | 10/1973 | Wood . | |
| 3,812,403 | 5/1974 | Gartner . | |
| 3,831,065 | 8/1974 | Martin . | |
| 3,871,474 | 3/1975 | Tomlinson et al. . | |
| 3,878,511 | 4/1975 | Wagner . | |
| 3,885,408 | 5/1975 | Clark, Jr. . | |
| 3,893,073 | 7/1975 | Angello . | |
| 4,189,712 | 2/1980 | Lemelson . | |
| 4,197,524 | 4/1980 | Salem . | |
| 4,205,325 | 5/1980 | Haygood et al. | 340/825.31 |
| 4,206,491 | 6/1980 | Ligman . | |
| 4,222,088 | 9/1980 | Burton . | |
| 4,249,245 | 2/1981 | Nakanishi et al. | 340/365 E |
| 4,327,255 | 4/1982 | Suszylo | 340/365 E |

*Primary Examiner*—Donald J. Yusko

*Attorney, Agent, or Firm*—Lowe, King, Price & Becker

[57] ABSTRACT

An electronic lock system is provided with an audible entry monitor for confirmation of entry of an input code and a mischief preventive circuit for disabling the audible entry monitor for a given period of time in response to an excessive number of inaccurate code input attempts. The audio signal generator is associated with a pushbutton input unit having a plurality of push buttons. The audio signal generator is adapted to produce an audible signal whenever an input code is entered through the input unit. The audible signal generator is also associated with a comparator for comparing the input code and a permanent code. The comparator is adapted to allow the system to change a voluntary code and operates the audible signal generator to produce another audible signal for a predetermined period while the system is capable of accepting entry of the new voluntary code to be preset.

9 Claims, 1 Drawing Figure

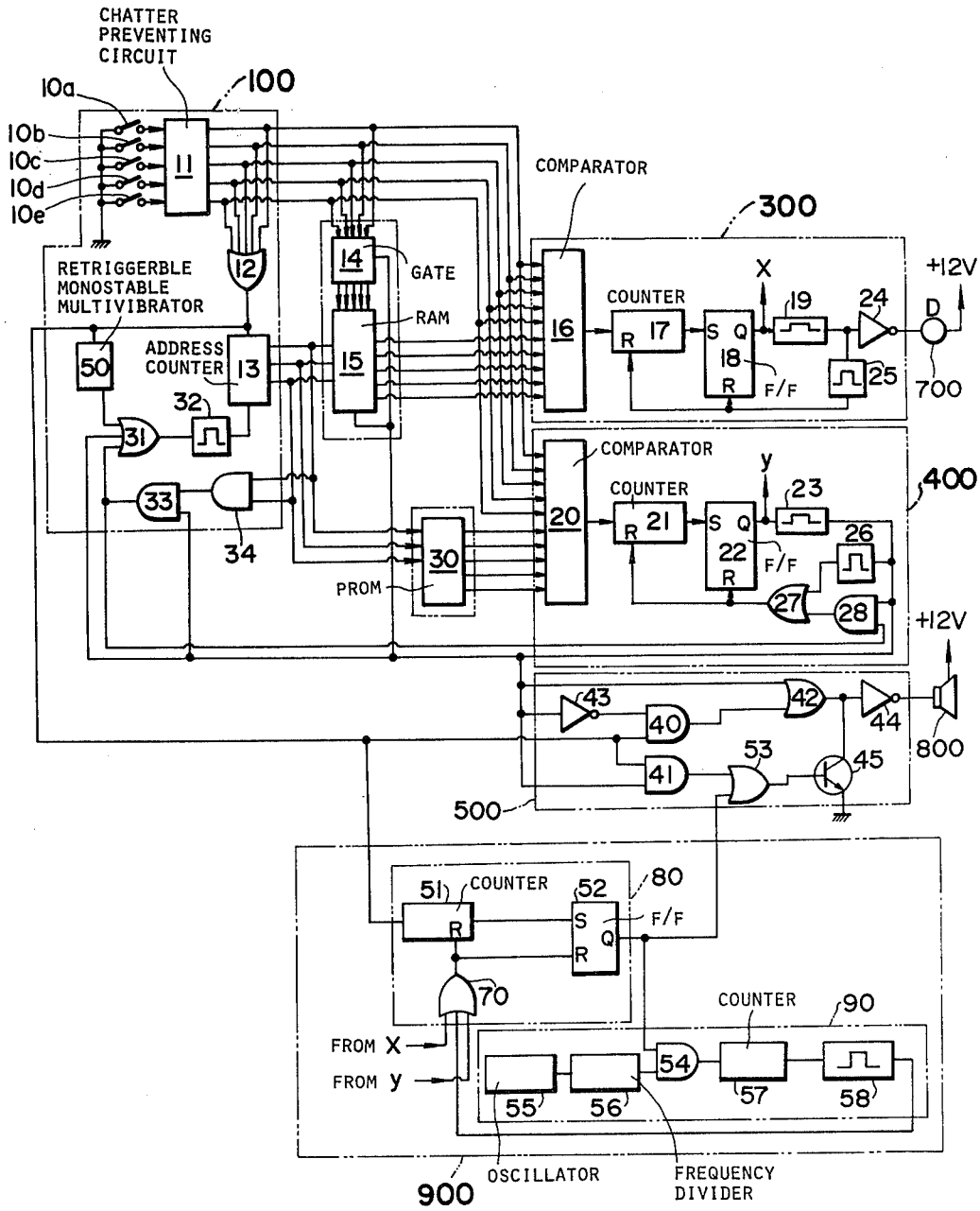
CHATTER PREVENTING CIRCUIT
100
10a
10b
10c
10d
10e
11
12
RETRIGGERBLE MONOSTABLE MULTIVIBRATOR
50
ADDRESS COUNTER
13
14
GATE
15
RAM
32
31
33
34
30
PROM
COMPARATOR
16
300
COUNTER
17
R
S
Q
18
R
F/F
X
19
24
25
D
+12V
700
COMPARATOR
20
400
COUNTER
21
R
S
Q
22
R
F/F
y
23
26
27
28
+12V
43
40
41
42
44
53
45
800
500
51
COUNTER
R
52
S
Q
R
F/F
80
70
COUNTER
90
FROM X
FROM y
54
55
56
57
58
OSCILLATOR
FREQUENCY DIVIDER
900

ELECTRONIC LOCK SYSTEM WITH AUDIBLE ENTRY MONITOR

BACKGROUND OF THE INVENTION

The present invention relates generally to an electronic lock system for operating a lock mechanism with an input code entered from a pushbutton keyboard. The invention especially relates to an electronic lock mechanism with an audible entry monitor which produces an audible signal each time one of the push buttons is operated.

Such an electronic lock system is applicable for an automotive door lock system. A typical automotive door lock system is disclosed in U.S. Pat. No. 4,205,325, issued on May 27, 1980 to Haygood et al which shows a keyless entry system for locking and unlocking a vehicle door lock mechanism. In Haygood et al, several functions are incorporated in a single keyless entry system for an automotive vehicle. Major improved features include a permanent preprogrammed code storage memory and a user programmable code storage memory, wherein either code may be inserted into the system to gain entry into the vehicle and enable the other functions. The other functions include the ability to unlock one or several doors of the vehicle, retract a sunroof, unlock a deck lid, lower selected side windows, reprogram a new user selected code into the programmable memory or disable the system response to the user selected code. These functions have been found to be highly desirable since they can be controlled to occur prior to entering the vehicle.

Five digit designated pushbutton keyboards on opposite vehicle doors are provided in the preferred embodiment, as the means by which all predetermined codes are manually entered into the system. A primary keyboard mounted on the left front (driver's) door is designated by the system to have continual override priority over the keyboard mounted on the right front (passenger's) door. However, each keyboard has independent operational capability to allow a user to enter correct digit codes and have the system perform the aforementined functions.

In operation of Haygood et al, depression of any pushbutton on either keyboard will cause illumination of the keyboard, activation of the system, and may also cause illumination of the vehicle interior for a predetermined period of time. In this manner, the system becomes visible for night operation and is activated to receive a multi-digit code which corresponds to either the permanent preprogrammed code or a programmed user selected code. The user then depresses a sequence of digitally designated pushbutton and each depression commences a new time period for illumination and activation. In order to eliminate excessive battery drain, the system will deactivate and illumination will terminate if the user hesitates longer than the predetermined time period. When proper entry of either the permanent or user selected multi-digit code is completed, the door upon which the particular keyboard is mounted will immediately unlock and allow entry to the passenger compartment of the vehicle. Subsequently, while the system remains activated during the aforementioned time period, predetermined digital pushbuttons may be depressed to unlock all the other vehicle doors, unlock the deck lid, retract the sunroof, lower the side windows, program a new user-selected code into the programmable memory, or disable the system response to the last programmed user-selected code.

In the particular point of the present invention, the keyless entry system can be operated via either of two different present codes. One of the preset codes is a permanent code which can also be used to allow reselection of the other preset code. The other code is a voluntary code or user's code and is the one normally used for door unlocking. The system permits change of the voluntary code when the newly desired voluntary code is inputted following the permanent code.

The system includes an audible entry monitor for confirmation of inputs. The entry monitor is adapted to produce an audible entry confirmation tone every time one of the push buttons is depressed. The entry monitor produces another audible signal when the system is ready to change the voluntary preset code for a given period of time during which the system will accept entry and change of the voluntary code.

In addition, the system has a mischief preventive circuit for preventing the electronic lock system from being mischiefed.

SUMMARY OF THE INVENTION

It is an object of the present invention to provide an electronic lock system having an audible entry monitor for confirmation of entry of an input code and a mischief preventive circuit which disables the audible entry monitor for a given period of time in response to an excessive number of inaccurate input code entry attempts.

According to the present invention, there is provided an electronic lock system including an audio signal generator associated with a pushbutton input unit having a plurality of push buttons. The audio signal generator is adapted to produce an audible signal whenever an input code is entered via the input unit. The audible signal generator is also associated with a comparator for comparing the input code and a permanent code. The comparator is adapted to allow the system to change a voluntary code and operates the audible signal generator to produce another audible signal for a given period during which the system is capable of accepting entry of the voluntary code to be preset.

In one embodiment, the electronic lock system comprises a lock mechanism including an actuator, a pushbutton input unit having a plurality of push buttons for entry of an input code, a memory for storing a preset code which is read out in response to entry of the input code, a comparator for comparing the input code with the preset code to produce a driver signal for operating the actuator when the input code matches the preset code, an audible signal generator for generating an audible signal of a given duration whenever one of the push buttons is depressed for entry of a code element of the input code, and a counter associated with the audible signal generator and adapted to count the occurrences of entry of the code elements and to produce a disabling signal for disabling the audible signal generator when the counter value thereof exceeds a given threshold value.

BRIEF DESCRIPTION OF THE DRAWINGS

The present invention will be understood from the detailed description given below and from the accompanying drawing which is a circuit diagram of the preferred embodiment of the mischief preventive electronic lock device according to the invention, which, however, should not be taken as limitative to the invention but for elucidation and explanation only.

DESCRIPTION OF THE PREFERRED EMBODIMENTS

Referring now to the drawing, there is illustrated a circuit construction of the preferred embodiment of an electronic lock system. An input section 100 comprises a plurality of push buttons 10*a* to 10*e* for inputting the code elements. If necessary, it is possible to provide another push button serving as a start button for initializing and/or resetting the system. The start button may also function to manually clear the code inputted when it includes a wrong code element. The start button may also be used to stop the actuator which moves the windows up and down.

A chatter prevention or anti-bounce circuit 11 outputs a digital signal from each of the keys 10*a* to 10*e* to an OR gate 12. The OR gate 12 outputs a high level signal whenever any of the keys 10*a* to 10*e* are depressed. The push buttons are, in turn, grounded.

The output of the OR gate 12 is applied to a retriggerable one-shot monostable multivibrator 50. This one-shot monostable multivibrator 50 is provided to reset the whole system via an OR gate 31 by outputting a reset signal if none of the push-button switches 10*a* to 10*e* have been depressed for a predetermined period of time, e.g., five seconds.

The output of OR gate 12 is also conducted to an address counter 13. Although the address counter 13 has both an UP terminal and a DOWN terminal, the output terminal of the OR gate 12 is connected solely to the UP terminal. Therefore, whenever one of the push-button switches 10*a* to 10*e* is depressed, the counter value of address counter 13 is incremented. The address counter 13 is adapted to produce an address signal representative of the current counter value thereof and corresponding to respective memory addresses in a non-volatile RAM 15 and a PROM 30 used for storing the permanent code and the user-selected code. The output lines of the address counter 13 are connected to the address input terminals of the RAM 15 and the PROM 30. The address signals of the address counter 13 are representative of the memory addresses of the RAM 15 and the PROM 30 to be accessed. The code element data stored in PROM 30 and the RAM 15 are read out from the corresponding addresses to provide first and second code element signals respectively indicative of the stored value in the respective accessed addresses. The first and second code element signals from the PROM 30 and the RAM 15 are applied to a comparator 20 in the first code comparator 400 and a comparator 16 in the second code comparator 300, respectively. Also applied to these comparators 20 and 16 are the code element signals outputted by the input unit 100 via chatter prevention circuit 11 by depression of the keys 10*a*–10*e*. Therefore, the comparator 20 consecutively compares each first code element inputted via the push-buttons 10*a*–10*e* with the corresponding stored first code element in the corresponding address of the PROM 30. The comparator 16 consecutively compares each second code element inputted via the push-buttons 10*a* 10*e* with the corresponding stored second code element in the RAM 15.

When the input unit 100 is operated to input a code, counting signals are applied to the address counter 13, via the OR gate 12. Th address signals thus produced are applied to the PROM 30 to read out the stored values in the corresponding memory addresses thereof. The read-out values of the PROM 30 are respectively outputted to the comparator 20. As stated, the comparator 20 thus receives the code element signals from the input unit 100 and the stored first code element signals from the PROM 30 to compare corresponding digits of each code.

In practice, the first code consists of, for example, seven code elements (digits). The comparator 20 produces a comparator output when the compared inputted code element or elements match the first code element or elements compared therewith. The comparator outputs are applied to an input terminal of a counter 21. Assuming the first code consists of seven encoded digits, the counter 21 produces a counter signal when the counter value reaches 7. The counter 21 is connected to a set input terminal of a flip-flop 22 to set the latter in response to the counter output. A set signal of the flip-flop 22 is fed to a oneshot multivibrator 23 to produce a trigger signal. The trigger signal is fed to another one-shot multivibrator 26, as well as to one input terminal of each of an AND gate 28 and the OR gate 31. The one-shot multivibrator 26 outputs a trigger signal to reset terminals of the counter 21 and the flip-flop 22 via the OR gate 27. Therefore, the counter 21 and the flip-flop 22 are reset by the trigger signal of the one-shot multivibrator 26. At the same time, the one-shot multivibrator 32 is triggered by the trigger signal from the one-shot multivibrator 23 via the OR gate 31 to reset the address counter 3. The trigger signal of the one-shot multivibrator 23 is also fed to one of the input terminals of an AND gate 33. The other input terminal of the AND gate 33 is connected to another AND gate 34 which is, in turn, connected to the address counter 13 to receive the address signal. The AND gate 34 is adapted to open when the address signal value reaches a predetermined value, e.g. 5. Therefore, in the presence of the trigger signal from the one-shot multivibrator 23, in other words while the one-shot multivibrator is triggered for a given period, the AND gate 33 is responsive to the output of the AND gate 34 to open. The output of the AND gate 34 is fed via the AND gate 33 and the AND gate 28 to trigger the OR gate 27 in the presence of the trigger signal of the one-shot multivibrator 23. This serves to reset the counter 21 and the flip-flop 22 after a predetermined number of code elements, e.g. 5, are entered through the input section 100 to reselect the second, user-selected code after the longer first, premanent has been properly entered.

The trigger signal of the one-shot multivibrator 23 is also fed to a gate 14 which is interposed between the input section 100 and the RAM 15. The gate 14 is responsive to the trigger signal of the one-shot multivibrator 23 to open to pass the inputted code to the RAM 15. The RAM 15 is also connected to the one-shot multivibrator 23 directly and responds to the trigger signal to change to write-in mode. Therefore, a new input code can be written into the RAM 15. In this way, a new second code can be preset.

When the inputted code is not the first code, only 5 code elements are needed so that the second code presetting mode is not produced. Therefore, the read/write terminal of the RAM 15 remains conditioned for reading out the stored code. The stored code in the RAM 15 is read out in response to the address signal and fed to the comparator 16. As with the foregoing comparator 20, the comparator 16 compares the inputted code element and the second code element read out from the RAM 15. The comparator 16 produces outputs whenever the input code element and the corresponding second code element match. The comparator output is fed to a counter 17 which counts the comparator outputs and outputs a counter signal when the counter value reaches a predetermined value, e.g. 5, to set a flip-flop 18. In response to the set signal from the flip-flop 18, a one-shot multivibrator 19 is triggered to actuate a lock mechanism 700 via an inverter 24. The one-shot multivibrator 19 is connected to another one-shot multivibrator 25 which is triggered in response to the trailing edge of the trigger signal of the one-shot multivibrator 19. The resulting trigger signal from the one-shot multivibrator 25 is fed to the reset terminals of the counter 17 and the flip-flop 18 to reset them. Therefore, the counter 17 and the flip-flop 18 are reset after a given delay corresponding the trigger period of the one-shot multivibrator 19 after actuation of the lock mechanism.

The trigger signal from the one-shot multivibrator 23 is fed to an audio monitor circuit 500. The audio monitor circuit 500 includes an OR gate 42 with one input terminal connected to the one-shot monostable multivibrator 23 to receive the trigger signal therefrom. The output of the OR gate 42 is fed to an audio signal generator 800 via an inverter 44. The audio signal generator 800 is responsive to the output of OR gate 42 to reproduce an audio signal as long as the output of the OR gate is present. At the same time, the one-shot multivibrator 23 feeds the trigger signal to one of the input terminals of an AND gate 40 via an inverter 43. The output terminal of the AND gate 40 is, in turn, connected to the other input terminal of the OR gate 42. The other input terminal of the AND gate 40 is connected to the OR gate 12 to receive a high-level signal every time an input is entered. The OR gate 12 is also connected to one of the input terminals of an AND gate 41, the output terminal of which is, in turn, connected to the base electrode of a transistor 45 via an OR gate 53. The collector electrode of the transistor 45 is connected to the output terminal of the OR gate 42, and the emitter electrode thereof is grounded. The other input terminal of the AND gate 41 is connected to the one-shot multivibrator 23 to receive the trigger signal therefrom. Therefore, as long as the trigger signal from the multivibrator 23 is present, the transistor 45 is turned on in response to the output of the OR gate 12 to interrupt the output of the gate 42 to interrupt production of the audio signal.

The other input terminal of OR gate 53 is connected to the Q-output terminal of a flip-flop 52 in a mischief prevention circuit 900. The SET input terminal of the flip-flop 52 is connected to the output terminal of a counter 51, the input terminal of which is, in turn, connected to the OR gate 12 to count the code entries. The counter 51 is adapted to produce a counter signal when the counter value reaches a predetermined value, e.g. 24. Since the counter value corresponds to keystrokes of the input unit, the counter produces a counter signal when the number of entered keystrokes reaches the predetermined value. When the flip-flop is set by the counter signal, a SET signal of the flip-flop 52 is fed to the base electrode of the transistor 45 to turn the latter ON. This grounds the ouptut of the OR gate 42 to interrupt production of the audio signal.

The Q-output of the flip-flop 52 is also connected to a timing counter 57 via and AND gate 54. The other input terminal of the AND gate 54 is also connected to an oscillator 55 via a frequency divider 56 to receive a clock pulse signal having a given interval, i.e. 1sec. Therefore, the timing counter 57 counts clock pulses in the presence of the SET signal of the flip-flop 52 in order to measure the period of time in which the flip-flop 52 remains SET. The timing counter 57 is adapted to produce a timing signal when the counter value reaches a preset value corresponding to a given time span i.e. 6 sec. The timing signal from the timing counter 57 is fed to a one-shot multivibrator 58 to trigger the latter. The trigger signal from the one-shot multivibrator 58 is fed to RESET terminals of the counter 51 and the flip-flop 52 via an OR gate 70 to reset the latter.

In absence of the trigger signal of the one-shot multivibrator 23, the transistor 45 can be turned OFF in response to the trigger signal of the one-shot multivibrator 58 to pass the output of OR gate 42 to the audio signal generator H.

On the other hand, the OR gate 70 is also connected to the Q-output terminals of the flip-flops 18 and 22 to receive the SET signals therefrom. As a result, the counter 51 and the flip-flop 52 are also reset by either of the outputs of the flip-flops 18 and 22.

As disclosed hereabove, the audio signal may be produced whenever a code element is entered through the input unit or as long as the system is in the write-in mode for a new voluntary code. The audio signal generator stops production of the audio signal when the number of keystrokes of the input unit exceeds a predetermined value and is kept inoperative for a given period. In this way, mischief is discouraged and the system is protected against unauthorized use.

Therefore, according to the present invention, mischief via the input unit can be satisfactorily prevented by discouraging entry of input code on a trial-and -error basis for the purpose of theft or mischief.

While the present invention has been described in terms of the specific embodiment, the invention can be embodied otherwise and be modified in many way without departing from the principle of the invention.

What is claimed is:

1. An electronic lock system comprising:
a lock mechanism including an actuator;
a pushbutton input unit having a plurality of push buttons for entry of an input code;
a memory for storing a preset code which is read out in response to entry of said input code;
a comparator for comparing said input code with said preset code and producing a driver signal for operating said actuator when said input code matches said preset code;
an audible signal generator for confirming entry of input code whenever one of said push buttons is depressed; and
a counter means associated with said audible signal generator for counting occurrence of entry of code elements of said input code and producing a disabling signal for disabling said audible signal generator for a predetermined time when the counter value exceeds a given threshold.

2. An electronic lock system comprising:
a lock mechanism including an actuator;
a pushbutton input unit having a plurality of push buttons for entry of an input code;
a memory for storing a preset code which is read out in response to entry of said input code;
a comparator for comparing said input code with said preset code producing a driver signal for operating said actuator when said input code matches said preset code;

an audible signal generator means for generating a confirming audible signal of a given duration when each of said push buttons is depressed for entry of a code element of said input code; and a counter means associated with said audible signal generator for counting occurrences of entry of a plurality of said code elements and producing a disabling signal for disabling said audible signal generator means when the counter value thereof exceeds a given threshold value.

3. The system as set forth in claim 1 or 2, wherein said counter means is associated with said comparator and responsive to said driver signal to reset the counter value.

4. The system as set forth in claim 3, which further comprises a timer circuit means associated with said counter means for defining a duration of said disabling signal for thus defining a time period in which said audible signal generator is disabled.

5. An electronic lock system comprising:

a lock mechanism including an electromagnetic actuator for operating said lock mechanism between a locking position and an unlocking position;

a pushbutton input unit having a plurality of push buttons for entry of an input code;

a first memory for storing a first preset code which is comprised of several digits of code elements and is read out in response to entry of said input code;

a second memory for storing a second preset code which is comprised of several digits of code elements and read out in response to entry of said input code, said second memory being variable in its operation mode between a read mode in which said second preset code can be read out and a write mode in which said input code is written in as replacement of said second preset code;

a first comparator for comparing said input code and said first preset code to produce a first comparator signal when said input code matches said first code, said first comparator signal switching said second memory operation mode from said read mode to said write mode;

a second comparator for comparing said input code and said second preset code to produce a second comparator signal when said input code matches said second preset code to actuate said actuator;

an audible signal generator means responsive to entry of each code element of said input code for producing a first audible signal and resonsive to said first comparator signal to produce a second audible signal; and a counter means associated with said audible signal generator means for counting occurrence of entry of said input code elements and producing a disabling signal for disabling said audible signal generator when the counter value exceeds a given threshold.

6. The system as set forth in claim 5, wherein said first comparator signal has a given duration and said second memory is maintained at said write mode within said given duration of said first comparator signal.

7. The system as set forth in claim 6, wherein said second audible signal has a duration corresponding to said given duration of said first comparator signal and is interrupted whenever one of said push buttons is depressed for entry of said input code element.

8. The system as set forth in claim 5, 6 or 7, wherein said counter means is associated with said second comparator and responsive to said second comparator signal to reset the counter value thereof.

9. The system as set forth in claim 8, which further comprises a timer circuit associated with said counter means for defining a duration of said disabling signal in order to define a time period in which said audio signal generator is disabled.

* * * * *

UNITED STATES PATENT AND TRADEMARK OFFICE

CERTIFICATE OF CORRECTION

PATENT NO. : 4,463,349

DATED : July 31, 1984

INVENTOR(S) : Haruo MOCHIDA; Keiichi SHIMIZU and Hirotoshi NAMAZUE

It is certified that error appears in the above-identified patent and that said Letters Patent is hereby corrected as shown below:

At [73], page 1 of the Patent, the Assignees should be:

--Nissan Motor Company, Ltd. and Kokusan Kinzoku Kogyo Company, Ltd., both of Tokyo, Japan--

Signed and Sealed this

*Twenty-first* Day of *May 1985*

[SEAL]

*Attest:*

DONALD J. QUIGG

*Attesting Officer* *Acting Commissioner of Patents and Trademarks*